US005542349A

United States Patent [19]

Gösslinghoff

[11] Patent Number: 5,542,349

[45] Date of Patent: Aug. 6, 1996

[54] PRESSING APPARATUS FOR FOLDED PRINTING PRODUCTS SUCH AS NEWSPAPERS, PERIODICALS AND PARTS THEREOF

[75] Inventor: Reinhard Gösslinghoff, Wetzikon, Switzerland

[73] Assignee: Ferag AG, Hinwil, Switzerland

[21] Appl. No.: 340,590

[22] Filed: Nov. 16, 1994

[30] Foreign Application Priority Data

Nov. 19, 1993 [CH] Switzerland ..... 3461/93-2

[51] Int. Cl.[6] ..... B30B 3/04

[52] U.S. Cl. ..... 100/161; 100/170; 100/171; 100/172; 100/173; 271/272

[58] Field of Search ..... 100/161, 170, 100/171–173, 176; 271/198, 272

[56] References Cited

U.S. PATENT DOCUMENTS

| | | | |
|---|---|---|---|
| 2,159,439 | 5/1939 | Leighton | 100/161 |
| 2,376,494 | 5/1945 | Larabee | 100/161 |
| 2,391,170 | 12/1945 | Labombarde | 271/216 |
| 3,257,110 | 6/1966 | Smethurst | 100/153 |
| 3,545,371 | 12/1970 | Reist | 100/176 |
| 3,669,008 | 6/1972 | Reist | 100/35 |
| 4,076,231 | 3/1978 | Kutzner et al. | 270/21 |
| 4,106,767 | 8/1978 | Schirrmeister et al. | 271/272 |
| 4,463,940 | 8/1984 | Mock | 270/54 |
| 4,973,001 | 11/1990 | Kästingschäfer et al. | 100/170 |
| 5,125,330 | 6/1992 | Reist | 100/35 |

FOREIGN PATENT DOCUMENTS

| | | | |
|---|---|---|---|
| 517277 | 10/1955 | Canada | 100/161 |
| 881976 | 9/1971 | Canada | 271/272 |
| 107424 | 5/1984 | European Pat. Off. . | |
| 417621 | 3/1991 | European Pat. Off. . | |
| 960352 | 4/1950 | France . | |
| 1042030 | 10/1953 | France | 100/172 |
| 2333647 | 7/1977 | France . | |
| 564977 | 7/1957 | Italy | 100/170 |
| 638030 | 4/1962 | Italy | 100/161 |

*Primary Examiner*—Stephen F. Gerrity
*Attorney, Agent, or Firm*—Bell, Seltzer, Park & Gibson, P.A.

[57] ABSTRACT

The printing products (33) to be pressed run through in an imbricated formation (S), in which the fold edges (33*a*) of the printing products (33) lie at the top, between the pressing rollers (3, 4, 5, 6) of two pairs of pressing rollers (1, 2) arranged one behind the other. The upper pressing rollers (3, 5) of each pair of pressing rollers (1, 2), which come directly into contact with the fold edges (33*a*), are fixedly mounted. On the other hand, the other pressing rollers (4, 6) of each pair of pressing rollers (1, 2) are mounted on each side in a common mounting (15), with the sides being resiliently mounted on pneumatic springs (16). The pressing rollers (3, 4, 5, 6) are driven individually by means of flexible drive belts (17, 18, 19, 20). By this arrangement, the printing products (33) can be pressed satisfactorily and gently even at high conveying speed.

14 Claims, 5 Drawing Sheets

PRESSING APPARATUS FOR FOLDED PRINTING PRODUCTS SUCH AS NEWSPAPERS, PERIODICALS AND PARTS THEREOF

BACKGROUND OF THE INVENTION

The present invention relates to an apparatus for pressing folded printing products, such as newspapers, periodicals and parts thereof.

Such pressing apparatuses serve for compressing folded, multi-sheet printing products in the region of their fold and pressing out the air trapped between the sheets.

U.S. Pat. No. 3,257,110 discloses such a pressing apparatus in which one of the pressing rollers of the pair of pressing rollers is mounted rotatably in pivotably mounted arms and is drawn by means of tension springs acting on these arms against the fixedly mounted, other pressing roller of the pair of pressing rollers.

It is an object of the present invention to provide a pressing apparatus of the described type and which, while of a space-saving design, is able even at a high conveying speed of the printing products to press the latter together very strongly and permanently in the fold region, without the printing products being damaged thereby.

SUMMARY OF THE INVENTION

The above and other objects and advantages of the present invention are achieved by the provision of a pressing apparatus which comprises a first pair of rotatably mounted pressing rollers, which define between them a passage nip for the printing products and including a first pressing roller which is fixedly mounted and a second pressing roller which is mounted so as to permit it to be forced back transversely to the conveying direction (F) of the printing products against the action of an elastic restoring force away from the first pressing roller. A second pair of pressing rollers is mounted downstream of the first pair of pressing rollers and likewise defines between them a passage nip for the printing products and includes a first pressing roller which is fixedly mounted and a second pressing roller which is mounted so as to permit it to be forced back transversely to the conveying direction (F) of the printing products against the action of an elastic restoring force away from the first pressing roller. Drive means is also provided for driving all of the pressing rollers individually.

The printing products preferably have their leading fold edges facing the fixedly mounted pressing rollers, and particularly effective pressing takes place in the fold region, since the pressing rollers acting directly on the fold edges cannot be forced back. This effective pressing, acting gently on the products, is further assisted by the pressing rollers being individually driven.

The fold region is permanently formed by the strong pressing, so that later no reversion of the fold occurs, which is of great advantage for the subsequent further processing.

EP-A-0 417 621 and the corresponding U.S. Pat. No. 5,125,330 disclose a pressing apparatus for printing products in which the products likewise run through two pairs of rollers, arranged one behind the other, each with a fixedly mounted roller and a resiliently mounted roller. Of these two pairs of rollers, however, only one pair of rollers serves for the actual product pressing, while the other pair of rollers is formed by guide rollers. The latter are not absolutely necessary, since they only serve, as mentioned, for guidance of the products pressed by means of the first pair of rollers. In the case of this known apparatus, it is also provided for the products to be passed through the pressing and guiding rollers in an imbricated formation such that the fold edge comes into contact with the fixedly mounted rollers. However, this pressing apparatus is designed for a different purpose, it serves for the pressing of printing products which run through the pairs of rollers with one corner ahead, i.e., with their fold edge slanted with respect to the conveying direction.

BRIEF DESCRIPTION OF THE DRAWINGS

An exemplary embodiment of the subject of the invention is explained in more detail below with reference to the drawing, in which, purely diagrammatically.

DETAILED DESCRIPTION OF THE PREFERRED EMBODIMENT

Figure 1:
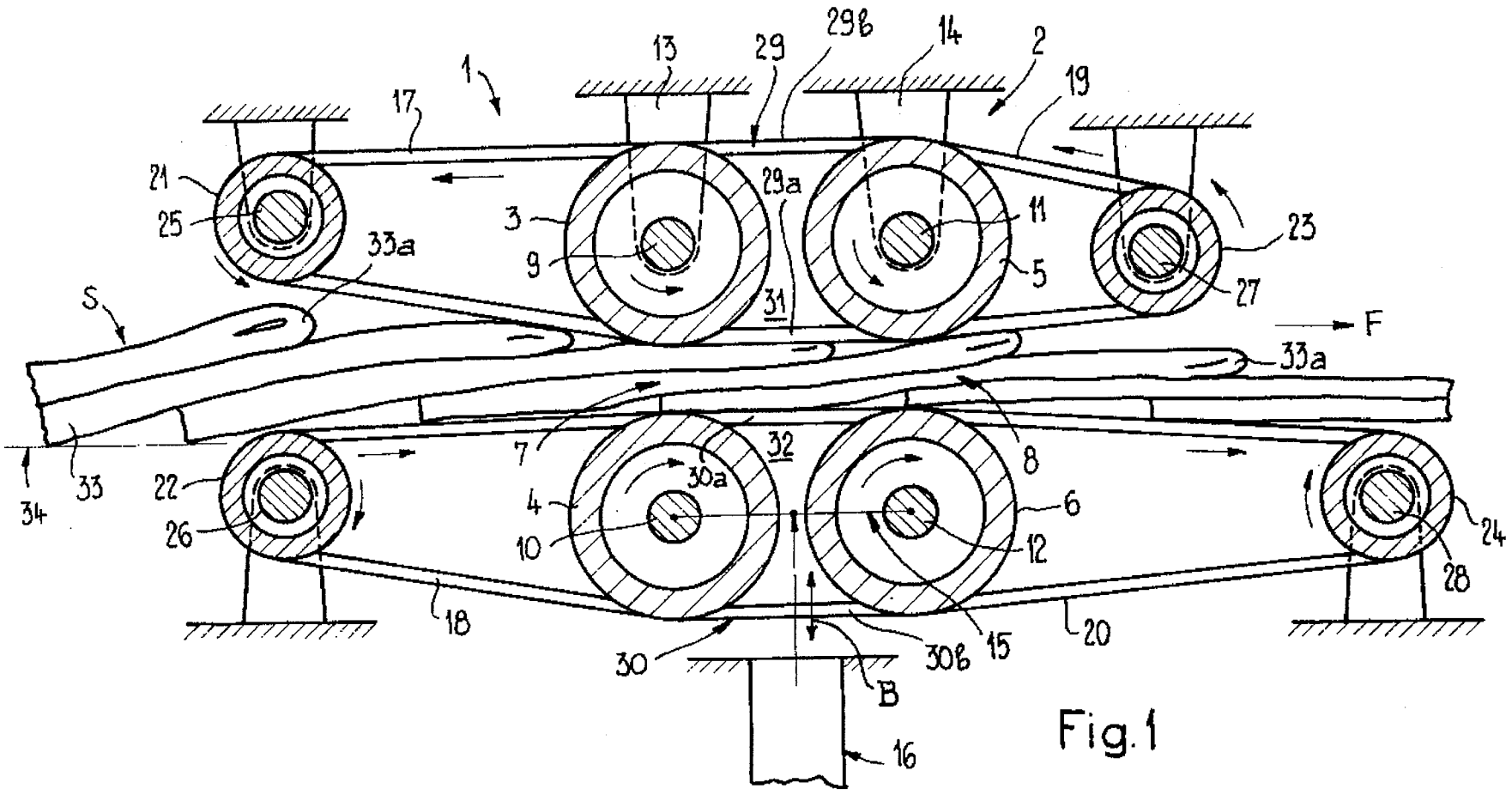
FIG. 1 shows in side view and in simplified representation part of an apparatus for pressing folded printing products running past in imbricated formation.

With reference to the simplified representation of FIG. 1, the basic construction of the pressing apparatus is explained below. The more specific construction of the pressing apparatus will be described later with reference to FIGS. 2–6.

The pressing apparatus has a first pair of pressing rollers 1 and a second pair of pressing rollers 2, arranged adjacent to the latter. The two cylindrical pressing rollers of each pair of pressing rollers 1 and 2 are denoted by 3 and 4 or 5 and 6, respectively. The pressing rollers 3 and 4 or 5 and of each pair of pressing rollers 1 and 2 define between them a passage nip 7 or 8, respectively. The pressing rollers 3, 4, 5, 6 are mounted rotatably on spindles 9, 10, 11 and 12, respectively. In this case, the spindles 9 and 11 of the two upper pressing rollers 3 and 5 are held fixedly in bearing parts, which in FIG. 1 are only diagrammatically represented and are denoted by 13 and 14. On the other hand, the spindles 10 and 12 of the two lower rollers 4 and 6 are mounted in a common mounting 15, represented only diagrammatically in FIG. 1, which is supported on pneumatic springs 16. The mounting 15, and consequently the pressing rollers 4 and 6, are consequently resiliently supported displaceably in the direction of the arrow B on the pneumatic springs 16, as will be described in more detail later.

The pressing rollers 3, 4, 5, 6 are driven individually by means of endless drive belts 17, 18, 19 and 20, respectively, of a flexibly extensible material, for example rubber. These drive belts 17, 18, 19, 20 run in grooves in the assigned pressing rollers 3, 4, 5, 6 over these pressing rollers 3, 4, 5, 6 and also over drive rollers 21, 22, 23 and 24, which are fastened on fixedly, but rotatably mounted spindles 25, 26, 27 and 28, respectively. The drive arrangement for driving the drive rollers 21, 22, 23 and 24 will be explained in more detail with reference to FIG. 2. Thanks to their flexible extensibility, the drive belts 17, 18, 19, 20 are capable of compensating for variations in the circumferential speed of the pressing rollers 3, 4, 5, 6. Such speed variations are caused, for example, by differences in the thickness of the imbricated formation running through the passage nips 7, 8.

Also passed over the drive rollers 21 and 23 on the one hand and the drive rollers 22 and 24 on the other hand are endless, flexible guide elements 29, 30, which run further over the pressing rollers 3 and 5 or 4 and 6, respectively. In FIG. 1, these guide elements 29, 30 are only partially visible, namely only the sections 29*a*, 29*b* and 30*a*, 30*b* which span and cover the intermediate space 31 and 32 between the pressing rollers 3 and 5 or 4 and 6, respectively. The arrangement of the drive belts 17, 18, 19, 20 and of the guide elements 29, 30 can be seen from FIG. 3.

In FIG. 1 there is also shown part of an imbricated formation S comprising printing products 33 lying one on top of the other in the manner of roof tiles. In this case, each printing product 33 rests on the preceding printing product, so that the leading fold edge 33*a* of each printing product 33 lies on the upper side of the imbricated formation S. A feed conveyor 34, serving for feeding the imbricated formation S, is only indicated entirely diagrammatically.

The printing products 33 run through the passage nips 7, 8 of the pairs of rollers 1 and 2 and are thereby pressed together.

The complete construction of the pressing apparatus is now explained with reference to FIGS. 2 to 6.

Figure 2:
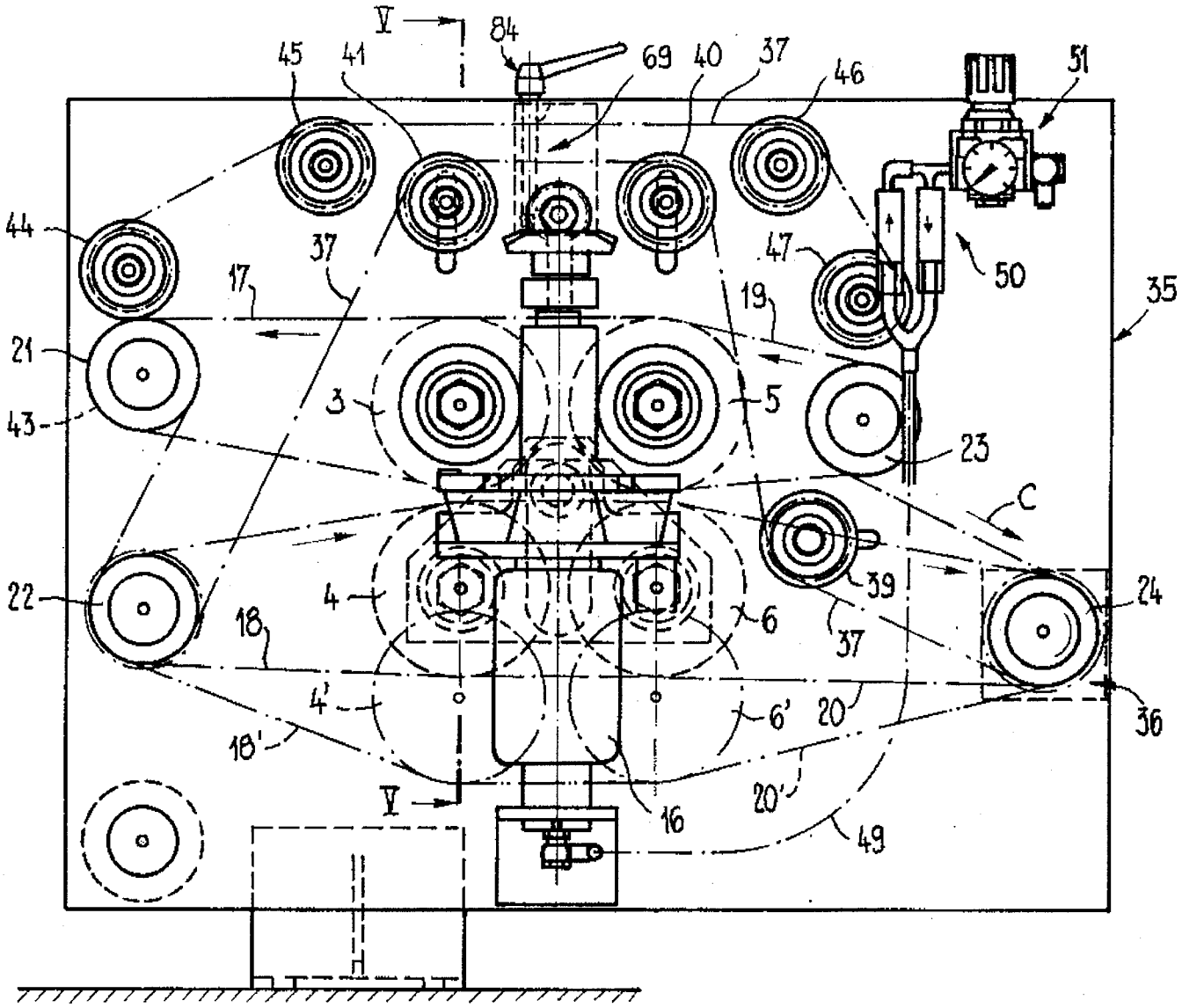
FIG. 2 shows in a side view corresponding to FIG. 1 the entire pressing apparatus.

In FIG. 2 the entire pressing apparatus is shown in side view. The components already explained with reference to FIG. 1 can also be seen in this FIG. 2, but to preserve better overall clarity not all these components are provided with the assigned reference numerals. With reference to FIG. 2 together with FIG. 3, in particular the drive system for the pressing rollers 3, 4, 5, 6 is explained. In the Figure showing a plan view, FIG. 3, only half of the apparatus is shown, certain parts having been omitted or cut away.

Figure 3:
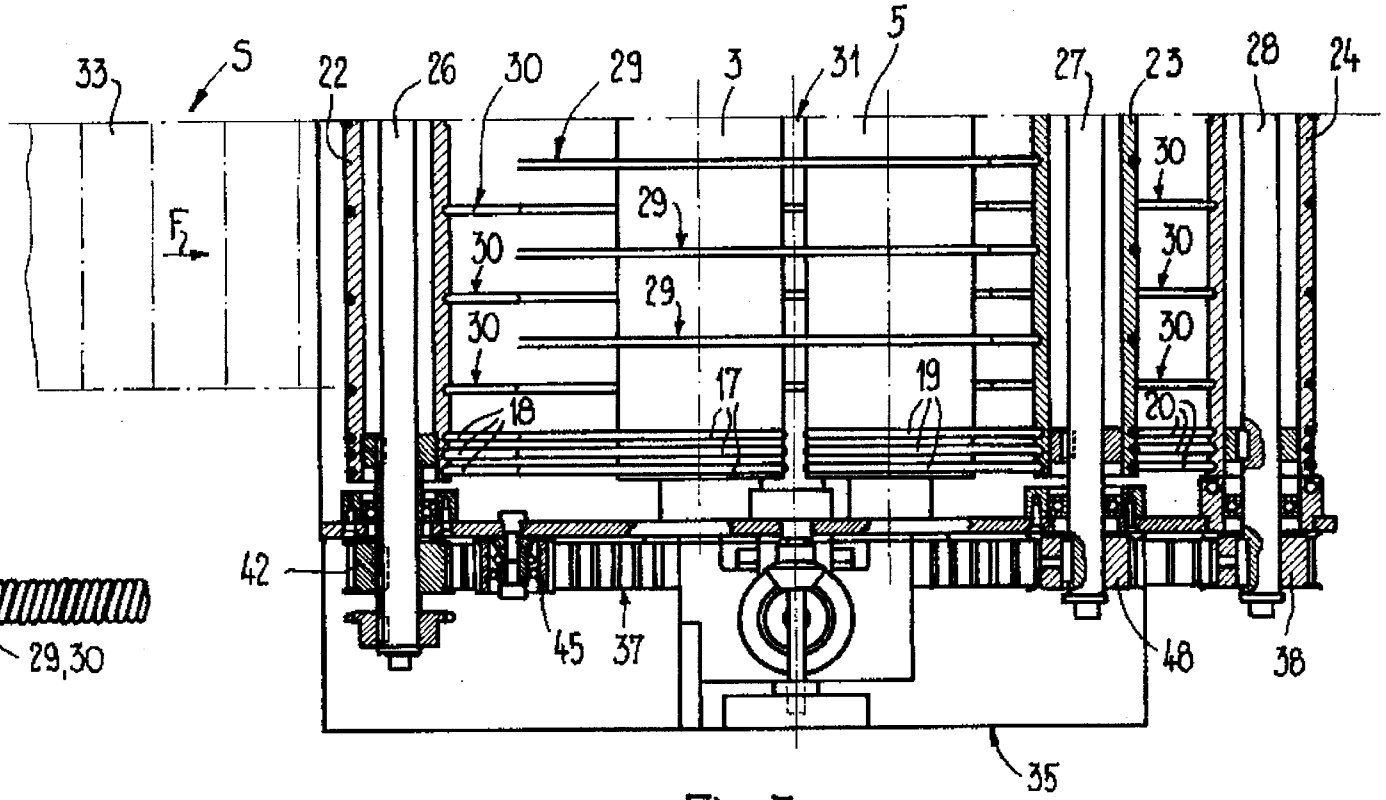
FIG. 3 shows half of the pressing apparatus according to FIG. 2 in plan view, certain parts being cut away.
Figure 4:
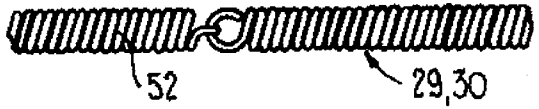
FIG. 4 shows a detailed representation of a guide element used in the pressing apparatus.

The components explained with reference to FIG. 1 are arranged or mounted in a frame 35. In this frame there is also an only diagrammatically represented drive 36, which drives the drive rollers 21, 22, 23 and 24 via an endless toothed bolt 37, provided on both sides with a toothing. The toothed belt 37 is passed over a gearwheel 38, which is seated on the spindle 28 which is driven by the drive 36 and to which the drive roller 24 is connected non-rotatably (FIG. 3). As FIG. 2 reveals, the gearwheel 38 turns clockwise and the toothed belt 37 moves in the direction of the arrow C. From the gearwheel 38, the toothed belt runs over deflecting rollers 39, 40 and 41 to a gearwheel 42 (FIG. 3) which is seated on the spindle 26 to which the drive roller 22 is connected. From this gearwheel 42, the toothed belt 37 is passed over a gearwheel 43 (FIG. 2) which is connected non-rotatably to the drive roller 21 (not shown in FIG. 3). From this gearwheel 43, the toothed belt 37 runs over deflecting wheels 44, 45, 46 and 47 to a gearwheel 48 (see FIG. 3) and from the latter to the already mentioned gearwheel 38. This gearwheel 48 is seated on the spindle 27, to which the drive roller 23 is connected non-rotatably.

As can be further seen from FIG. 2, the pneumatic springs 16 are connected via a pressure line 49 to a pressure control unit 50, which is connected to a compressed air connection 51. By means of the pressure control unit 50, the pressure inside the pneumatic springs 16, and consequently also the force exerted by the compression springs 16, is set to particular values in each case.

As mentioned, the arrangement of the drive belts 17, 18, 19, 20 of the guide elements 29 and 30 can be seen from FIG. 3, these drive belts and guide elements being represented partially cut away. As FIG. 3 reveals, the drive belts 17, 18, 19, 20 are arranged laterally of the pressing rollers 3, 4, 5, 6, while the guide elements 29, 30 are arranged such that they are distributed over the length of the pressing rollers 3, 4, 5, 6 and offset with respect to one another.

As is evident from FIG. 1 in particular, the guide elements 29, 30 serve for guiding the fed printing products 33 into the passage nip of the first pair of pressing rollers 1 and for covering the intermediate space 31, 32 between the pressing rollers 3 and 5 and also 4 and 6, in order that the printing products 33 cannot penetrate into this intermediate space 31, 32 but reach the passage nip 8 of the second pair of pressing rollers 2. Consequently, the guide elements 29, 30 come into contact with the printing products 33. If the pressing apparatus shown is arranged in the direct vicinity of the output of a rotary printing machine, there is therefore the risk of smearing the not yet quite dry printing ink. To avoid this, the guide elements 29, 30 are produced from a thin, helically wound wire 52, such as that shown in FIG. 4. The guide elements 29, 30 are consequently designed as long and thin helical springs.

Figure 5:
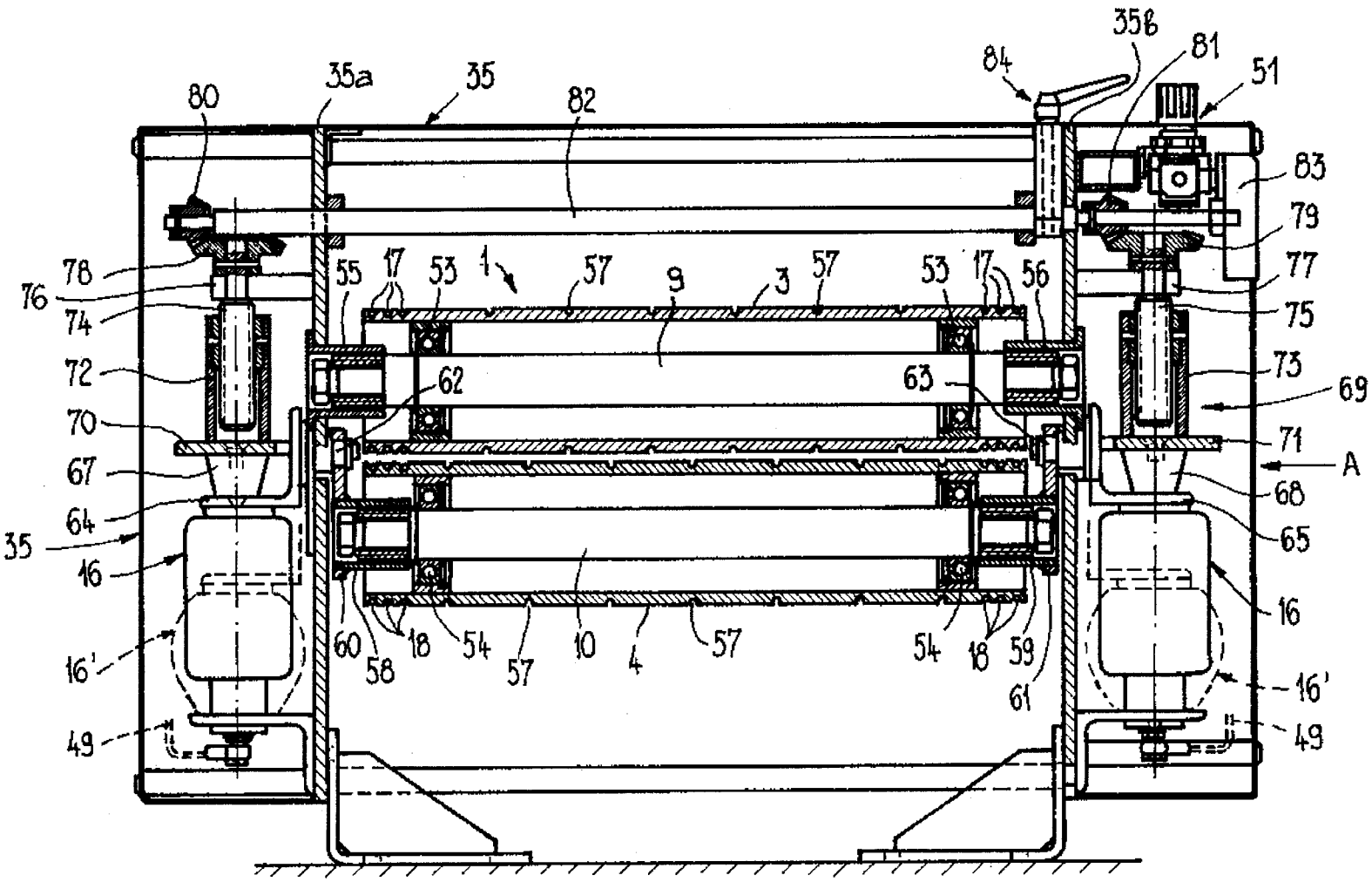
FIG. 5 shows a section along the line V—V in FIG. 2.
Figure 6:
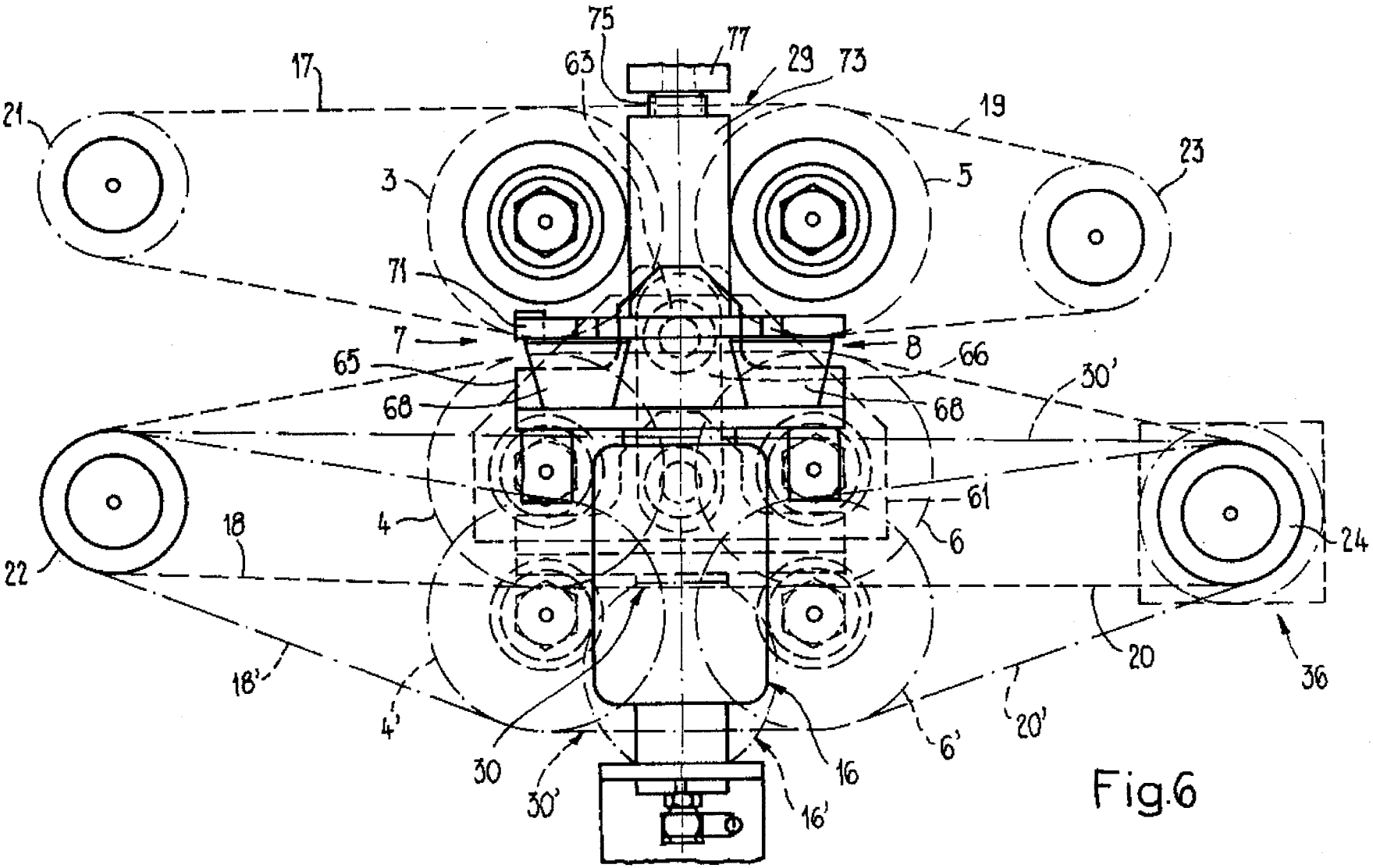
FIG. 6 shows a simplified view of the pressing apparatus in the direction of the arrow A in FIG. 5.

The type of mounting of the pressing rollers 3, 4, 5 and 6 is now to be described with reference to FIGS. 5 and 6.

The pressing rollers 3, 4, 5 and 6 are mounted by means of ball bearings 53 and 54 on the assigned spindle 9, 10, 11 and 12, respectively. The fixed spindles 9 and 11 of the upper pressing rollers 3 and 5 are held in bearing bushes 55 and 56, which are firmly attached on the frame 35. All the pressing rollers 3, 4, 5, 6 are provided on their circumference with grooves 57, into which the guide elements 29 and 30 come to lie.

The spindles 10 and 12 of the lower pressing rollers 4 and 6, respectively are likewise held in bearing bushes 58 and 59, which are attached on a bearing plate 60 and 61, common to both pressing rollers 4 and 6. Each of these bearing plates 60, 61 is connected by means of a connecting bolt 62 and 63 to the one leg of an L profile 64 and 65, respectively. These connecting bolts 62, 63 extend through a slot 66 (FIG. 6) in a side wall 35*a* and 35*b*, respectively, of the frame 35. The other leg of the L profile 64 and 65 is firmly connected to the upper end of the assigned pneumatic spring 16. On this leg of the L profile 64 and 65 there rest in each case two damping elements 67, 68 of rubber, which belong to a setting device 69, which is represented in FIG. 5. The damping elements 67, 68 are fastened on a plate 70, or 71 respectively, which is firmly connected to a tube piece 72, 73 with an internal thread. In the internal thread of the tube pieces 72, 73 there engages a threaded bolt 74, 75, which is mounted rotatably in a guide part 76 and 77 fastened on the frame wall 35*a* and 35*b*, respectively. Each threaded bolt 74, 75 is connected non-rotatably to a bevel gear 78 and 79, respectively, which is in engagement with a further bevel gear 80 and 81, respectively. The bevel gears 80 and 81 are seated non-rotatably on a shaft 82, which can be turned by means of a hand wheel 83. For arresting the shaft 82, a manually operable arresting device 84 is provided.

By means of the setting device 69, the size of the passage nips 7 and 8 can be set. By turning the hand wheel 83, the plates 70 and 71 with the damping elements 67 and 68 are raised and lowered. This raising and lowering movement of the damping elements 67, 68 is transferred to the L profiles 64, 65, which has the consequence of a corresponding raising and lowering of the spindles 10 and 12 and of the pressing rollers 4 and 6 mounted on the latter. The pneumatic springs 16 follow this movement of the L profiles 65. In FIGS. 2, 5 and 6, the pressing rollers 4 and 6 and the components moving along with the latter are shown by dot-dashed lines in their lower end position and are denoted by the assigned reference numerals, provided with a '. As FIG. 6 shows, the pressing rollers 4' and 6' located in the lower end position are no longer in contact with the upper strand of the guide elements 30'. In this lower end position of the pressing rollers 4', 6', no pressing of the printing products 33 takes place any longer.

To the extent that it has not already emerged from the above description, the pressing operation is further explained below.

The printing products 33 fed in conveying direction F to the first pair of pressing rollers 1 are passed via the guide elements 29, 30 to the passage nip 7 between the pressing rollers 3 and 4. On running through this passage nip 7, a first pressing of the printing products 33 takes place. For strong compressing of the printing products 33 it is important that the upper-lying fold edges 33*a* of the printing products 33 come into contact with the fixed pressing roller 3. The printing products 33 then pass into the second passage nip 8 between the pressing rollers 5 and 6 of the second pair of pressing rollers 2. The sections 29*a* and 30*a* of the guide elements 29 and 30 prevent the printing products 33 being able during this movement by them to enter into the intermediate space 31 or 32 between the pressing rollers 3 and 5 or 4 and 6, respectively. On running through the second passage nip 8, a repeated pressing together of the printing products 33 takes place.

The lower pressing rollers 4, 6 are resiliently supported by the pneumatic springs 16, which makes it possible for these pressing rollers 4, 6 to follow the differences in thickness in the imbricated formation S. By the use of pneumatic springs 16, which respond more quickly to loading variations than helical springs, it is possible to correct the pressing rollers 4, 6 all the time to the contour of the imbricated formation S. The force which the compression springs 16 exert can be changed in a simple way by means of the pressure control unit 50 and set to the value desired in each case. The described design of the mounting of the shafts 10, 12 of the pressing rollers 4, 6 also permits a certain pivoting or locking movement of the bearing plates 60, 61 about the longitudinal axis of the connecting bolts 62, 63. This pivoting movement is damped by the damping elements 67, 68.

If there has to be processed an imbricated formation in which, other than as shown in FIG. 1, each printing product rests on the following printing product and the leading fold edge consequently lies on the lower side of the imbricated formation, the fixed and sprung pressing rollers must be interchanged, i.e. the fixed pressing rollers are then to be arranged on the lower side of the imbricated formation in order that they can act directly on the fold edges of the printing products in this case as well.

In the drawings and specifications, there has been set forth a preferred embodiment of the invention, and although specific terms are employed, they are used in generic and descriptive sense only and not for purpose of limitation.

What is claimed is:

1. Apparatus for pressing folded printing products (33) which are fed in an imbricated formation (S) with the leading fold edges (33*a*) extending at right angles to the conveying direction (F), comprising a first pair (1) of rotatably mounted pressing rollers (3, 4), which define between them a passage nip (7) for the printing products (33) and including a first pressing roller (3) and a second pressing roller (4), means fixedly mounting said first pressing roller (3), and means mounting said second pressing roller (4) so as to permit it to be forced transversely to the conveying direction (F) of the printing products (33) against the action of an elastic restoring force (16) and away from the first pressing roller (3), a second pair (2) of pressing rollers (5, 6), mounted downstream of said first pair of pressing rollers and which likewise define between them a passage nip (8) for the printing products (33) and including a first pressing roller (5) and a second pressing roller (6), means fixedly mounting said first pressing roller (5), and means mounting said second pressing roller (6) so as to permit it to be forced transversely to the conveying direction (F) of the printing products (33) against the action of an elastic restoring force (16) and away from the first pressing roller (5), drive means (17–24, 36–48) for driving all of the pressing rollers (3, 4, 5, 6) individually, said drive means comprising at least one endless drive element (17, 18, 19, 20) of elastically extensible material, which is passed over each of said pressing rollers and a drive roller (21, 22, 23, 24), and wherein the first, fixedly mounted pressing rollers (3, 5) of both pairs of pressing rollers (1, 2) are arranged on that side of the imbricated formation (S) on which the fold edges (33*a*) of the printing products (33) lie freely.

2. Apparatus according to claim 1, wherein said drive means comprises a plurality of endless drive elements (17, 18, 19, 20) which are passed over respective ones of said pressing rollers and respective drive rollers (21, 22, 23, 24), and wherein the drive rollers (21, 22, 23, 24) are in drive connection with an endless drive member (37), and wherein said drive member (37) is driven in circulation by a drive element (36).

3. Apparatus according to claim 1, wherein said drive means further comprises at least one first circulating guide element (29) passed at least over the first pressing roller (3) of the first pair of pressing rollers (1), and at least one second circulating guide element (30) passed at least over the second pressing roller (4) of the first pair of pressing rollers (1), the two guide elements (29, 30) being formed of an elastic, extensible material and forming a guide for the printing products (33) to the passage nip (7) between the pressing rollers (3, 4) of the first pair of pressing rollers (1).

4. Apparatus according to claim 3, wherein the first guide element (29) is also passed over the first pressing roller (5) of the second pair of pressing rollers (2) and so as to extend between the first pressing roller (3) of the first pair of pressing rollers and the first pressing roller (5) of the second pair of pressing rollers, and the second guide element (30) is also passed over the second pressing roller (6) of the second pair of pressing rollers (2) and so as to extend between the second pressing roller (4) of the first pair of pressing rollers and the second pressing roller (6) of the second pair of pressing rollers.

5. Apparatus according to claim 3, wherein the first and second guide elements (29, 30) each comprise a long helical spring composed of a helically wound wire (52).

6. Apparatus according to claim 1, wherein said means mounting the second pressing roller (4, 6) of each pair of pressing rollers (1, 2) includes at least one pneumatic spring (16).

7. Apparatus according to claim 6, wherein the second pressing rollers (4, 6) define a first pair of adjacent ends which are mounted in a first common bearing part (60) and a second pair of adjacent ends which are mounted in a second common bearing part (61), and wherein the first and second common bearing parts are each supported on a separate pneumatic spring (16).

8. Apparatus according to claim 6, wherein said at least one pneumatic spring (16) is connected to a pressure control unit (50) for setting the pressure inside said at least one pneumatic spring (16).

9. Apparatus according to claim 1, wherein said means mounting said second pressing rollers (4, 6) of each pair of pressing rollers (1, 2) further comprises a setting device (69) for adjusting the size of the respective passage nips (7, 8).

10. An apparatus for processing folded printing products (33), comprising means for feeding the folded printing products in an imbricated formation (S) with the leading fold edges (33*a*) extending at right angles to a conveying direction (F), a first pair (1) of rotatably mounted pressing rollers (3, 4), which define between them a passage nip (7) for the printing products (33) and including a first pressing roller (3) and a second pressing roller (4), means fixedly mounting said first pressing roller (3), and means mounting said second pressing roller (4) so as to permit it to be forced transversely to the conveying direction (F) of the printing products (33) against the action of an elastic restoring force (16) and away from the first pressing roller (3), a second pair (2) of pressing rollers (5, 6), mounted downstream of said first pair of pressing rollers and which likewise define between them a passage nip (8) for the printing products (33) and including a first pressing roller (5) and a second pressing roller (6), means fixedly mounting said first pressing roller (5), and means mounting said second pressing roller (6) so as to permit it to be forced transversely to the conveying direction (F) of the printing products (33) against the action of an elastic restoring force (16) and away from the first pressing roller (5), drive means (17–24, 36–48) for driving all of the pressing rollers (3, 4, 5, 6) individually, and wherein the first, fixedly mounted pressing rollers (3, 5) of both pairs of pressing rollers (1, 2) are arranged on that side of the imbricated formation (S) on which the fold edges (33*a*) of the printing products (33) lie freely.

11. Apparatus according to claim 10 wherein said drive means comprises at least one endless drive element (17, 18, 19, 20) of elastically extensible material, which is passed over each of said pressing rollers and a drive roller (21, 22, 23, 24).

12. Apparatus according to claim 10 wherein said drive means comprises a plurality of endless drive elements (17, 18, 19, 20) which are passed over respective ones of said pressing rollers and respective drive rollers (21, 22, 23, 24), and wherein the drive rollers (21, 22, 23, 24) are in drive connection with an endless drive member (37), and wherein said drive member (37) is driven in circulation by a drive element (36).

13. Apparatus according to claim 12, wherein said drive means further comprises at least one first circulating guide element (29) passed at least over the first pressing roller (3) of the first pair of pressing rollers (1), and at least one second circulating guide element (30) passed at least over the second pressing roller (4) of the first pair of pressing rollers (1), the two guide elements (29, 30) being formed of an elastic, extensible material and forming a guide for the printing products (33) to the passage nip (7) between the pressing rollers (3, 4) of the first pair of pressing rollers (1).

14. Apparatus according to claim 13 wherein the first guide element (29) is also passed over the first pressing roller (5) of the second pair of pressing rollers and so as to extend between the first pressing roller (3) of the first pair of pressing rollers and the first pressing roller (5) of the second pair of pressing rollers, and the second guide element (30) is also passed over the second pressing roller (6) of the second pair of pressing rollers (2) and so as to extend between the second pressing roller (4) of the first pair of pressing rollers and the second pressing roller (6) of the second pair of pressing rollers.

* * * * *